US009345926B2

(12) United States Patent
Cauchon et al.

(10) Patent No.: US 9,345,926 B2
(45) Date of Patent: May 24, 2016

(54) EXERCISE MACHINE AND PIVOTING ASSEMBLY THEREFOR

(76) Inventors: Jean Cauchon, Pierrefonds (CA); Raphael Murillo Sterling, Montreal (CA); Fernando Saturno, Montreal (CA)

( * ) Notice: Subject to any disclaimer, the term of this patent is extended or adjusted under 35 U.S.C. 154(b) by 181 days.

(21) Appl. No.: 13/880,915

(22) PCT Filed: Jan. 28, 2011

(86) PCT No.: PCT/CA2011/000101

§ 371 (c)(1), (2), (4) Date: Apr. 22, 2013

(87) PCT Pub. No.: WO2012/055004

PCT Pub. Date: May 3, 2012

(65) Prior Publication Data

US 2013/0210586 A1 Aug. 15, 2013

Related U.S. Application Data

(60) Provisional application No. 61/408,202, filed on Oct. 29, 2010.

(51) Int. Cl.

| | |
|---|---|
| ***A63B 22/00*** | (2006.01) |
| ***A63B 22/04*** | (2006.01) |
| ***A63B 22/06*** | (2006.01) |
| ***A63B 71/02*** | (2006.01) |
| *A63B 21/22* | (2006.01) |

(52) U.S. Cl.

CPC ..... *A63B 22/04* (2013.01); *A63B 22/001* (2013.01); *A63B 22/0664* (2013.01); *A63B 71/02* (2013.01); *A63B 21/225* (2013.01); *A63B 22/0605* (2013.01); *A63B 2022/067* (2013.01); *A63B 2209/00* (2013.01); *A63B 2225/30* (2013.01)

(58) Field of Classification Search

CPC ..... A63B 22/001; A63B 22/0076; A63B 22/0664; A63B 22/04; A63B 22/0605; A63B 22/067; A63B 2022/0043

USPC ..... 482/51, 52, 57, 63–65, 110

See application file for complete search history.

(56) References Cited

U.S. PATENT DOCUMENTS

| | | | | |
|---|---|---|---|---|
| 6,149,551 | A * | 11/2000 | Pyles et al. | 482/52 |
| 6,672,992 | B1 * | 1/2004 | Lo et al. | 482/52 |
| 7,537,548 | B1 * | 5/2009 | Stearns et al. | 482/52 |
| 8,419,596 | B2 * | 4/2013 | Lai | 482/52 |
| 2002/0142890 | A1 * | 10/2002 | Ohrt et al. | 482/52 |
| 2006/0100064 | A1 * | 5/2006 | Pan et al. | 482/52 |
| 2006/0142122 | A1 * | 6/2006 | Kettler et al. | 482/52 |
| 2007/0032350 | A1 * | 2/2007 | Alessandri et al. | 482/52 |
| 2007/0298935 | A1 * | 12/2007 | Badarneh et al. | 482/52 |

* cited by examiner

*Primary Examiner* — Oren Ginsberg
*Assistant Examiner* — Nyca T Nguyen

(57) ABSTRACT

There is provided an exercise machine including a frame, a wheel assembly rotatably mounted to the frame and an actuating assembly operatively connected to the wheel assembly, the actuating assembly being operable by a user to urge rotation of the wheel assembly. The frame includes a wheel mounting member having a central opening defined therein for mounting the wheel assembly to the frame. A central mounting plate is sized and shaped for engaging the central opening, the central mounting portion having a concave indent defined therein for rotatable receiving a wheel axle part of the wheel assembly.

15 Claims, 13 Drawing Sheets

EXERCISE MACHINE AND PIVOTING ASSEMBLY THEREFOR

CROSS REFERENCE TO RELATED APPLICATIONS

This application claims the benefits of U.S. provisional patent application No. 61/408,202 filed on Oct. 29, 2010, the specification of which is hereby incorporated by reference.

TECHNICAL FIELD

The invention relates to exercise machines. More particularly, the invention pertains to outdoors exercise machines and to pivoting assemblies therefor.

BACKGROUND

Exercise machines are widely used for physical exercise. Typically, an exercise machine comprises a frame and one or more moving elements movable relative to the frame, the moving elements being actuatable by a user applying a force thereto using a body part, for instance his arms or legs. The moving elements usually guide the body part along a predetermined path to thereby enable exercising of muscles in the body part. The moving elements may also exert a resistant force opposed to the force applied by the user to further exercise the muscles. Examples of such machines are elliptical trainers and stationary bicycles.

For various reasons, the user may want to exercise outdoors. For instance, the exercise machine may be part of a public exercising program in which one or more exercise machines are provided in public outdoor areas to encourage people to exercise to improve their health or stay in shape.

Unfortunately, exercise machines are usually not adapted to be used outdoors, because they are often relatively costly, complicated to manufacture and/or install or may be damaged by natural elements such as rain or dirt. In particular, rain and/or dirt may accumulate in joints between moving elements, which may cause the moving elements to become increasingly harder to move over time.

Some exercise machines are manufactured particularly to be used outdoors. Unfortunately, those outdoors exercise machines usually do not address and/or overcome the above-identified drawbacks.

There is therefore a need for an exercising machine which would overcome at least one of the above-identified drawbacks.

Features of the invention will be apparent from review of the disclosure, drawings and description of the invention below.

BRIEF SUMMARY

According to one aspect, there is provided an exercise machine comprising a frame, a wheel assembly rotatably mounted to the frame, an actuating assembly operatively connected to the wheel assembly, the actuating assembly being operable by a user to urge rotation of the wheel assembly, wherein at least one of the wheel assembly and the actuating assembly comprises a first member, a second member pivotably connected to the first member and a first plain bearing element slidably mounted between the first member and the second member to enable frictionless pivoting of the first member relative to the second member.

In one embodiment, the first plain bearing element is manufactured from a material having a low coefficient of friction selected from a group consisting of nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber and fiberglass.

In one embodiment, the actuating assembly comprises an axle, the first member and the second member being mounted to the axle, at least one of the first member and the second member being rotatable to enable pivoting of the second member relative to the first member.

In one embodiment, the first member comprises a first side surface extending perpendicularly to the axle; further wherein the second member having a second side surface parallel to the first surface and spaced therefrom, the first plain bearing element contacting the first side surface and the second side surface, the first plain bearing element being slidably movable relative to at least one of the first side surface and the second side surface.

In one embodiment, the first plain bearing element is disc-shaped.

In one embodiment, the second member comprises an elongated housing secured to the frame, the housing having a first end portion, a second end portion and a chamber extending between the first end portion and the second end portion for housing the axle.

In one embodiment, the first end portion comprises a first exterior planar surface defining the second side surface.

In one embodiment, the second end portion comprises a second exterior planar surface defining a third side surface.

In one embodiment, the exercise machine further comprises a holding member secured to the axle, the holding member being adjacent the second end portion of the housing for holding the housing between the holding member and the first member, the holding member having a fourth side surface facing towards the housing; and a second plain bearing element mounted between the holding member and the second end portion, the second plain bearing element contacting the third side surface and the fourth side surface to enable frictionless pivoting of the housing relative to the holding member.

In one embodiment, the frame comprises a receiving recess sized and shaped for slidably receiving the housing.

In one embodiment, the frame comprises a wheel mounting member for mounting the wheel assembly to the frame, the wheel mounting member being generally flat and having a central opening defined therein.

In one embodiment, the wheel assembly comprises a first outer wheel portion, a second outer wheel portion extending parallel to the first outer wheel portion and spaced apart therefrom, a wheel axle extending between the first outer wheel portion and the second outer wheel portion, and a central mounting plate sized and shaped for engaging the central opening of the wheel mounting member, the central mounting plate being parallel to the wheel mounting member, the central mounting portion having a concave indent defined therein for rotatably receiving the wheel axle.

In one embodiment, the first plain bearing element comprises a first spacer mounted on the wheel axle between the first outer wheel portion and the wheel mounting member for enabling frictionless rotation of the first outer wheel portion relative to the wheel mounting member.

In one embodiment, the wheel assembly further comprises a second spacer mounted on the wheel axle between the second outer wheel portion and the wheel mounting member for enabling frictionless rotation of the second outer wheel portion relative to the wheel mounting member.

In one embodiment, the central mounting plate is manufactured from a material having a low coefficient of friction selected from a group consisting of nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber and fiberglass.

In one embodiment, the actuating assembly comprises a lever arm pivotably connected to the frame, the lever arm having a first end defining a handle and a second end, and a pedal member having a first end pivotably connected to the second end of the lever arm and a second end pivotably connected to the wheel assembly.

In one embodiment, the second end of the lever arm comprises a cylindrical sleeve for engaging the first end of the pedal member, the cylindrical sleeve defining a cylindrical bore adapted for receiving a cylindrical plain bearing to enable frictionless pivoting of the lever arm relative to the pedal member.

In one embodiment, the cylindrical plain bearing is manufactured from a material having a low coefficient of friction selected from a group consisting of nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber and fiberglass.

In one embodiment, the actuating assembly further comprises a rear pivoting assembly for pivotably connecting the second end of the lever arm to the wheel assembly, the rear pivoting assembly being positioned eccentrically relative to the wheel assembly.

In one embodiment, the rear pivoting assembly comprises a pivot pin extending away from the wheel assembly, an annular plain bearing pivotably mounted on the pivot pin, and an annular sleeve connected to the second end of the pedal member, the annular sleeve being slidably engaged over the annular plain bearing, the annular plain bearing enabling frictionless pivoting of the annular sleeve relative to the pivot pin.

In one embodiment, the annular plain bearing is manufactured from a material having a low coefficient of friction selected from a group consisting of nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber and fiberglass.

In one embodiment, the exercise machine comprises one of an elliptical machine and a stationary bicycle.

It will be appreciated that movement of the parts of the exercise machine relative to each other is facilitated by the use of one or more plain bearings manufactured from materials having relatively low friction coefficient. This type of bearings further eliminates the need for enclosure such as a ball bearing cage in which dirt and water may accumulate and damage the bearing. The use of plain bearings further advantageously eliminates the need to use metallic parts in the bearings, which may rust, oxidize or otherwise be damaged by natural elements such as air and rain.

It will be appreciated that this exercise machine is particularly well adapted to be used in outdoor gyms, which usually includes one or more exercise machines installed in a public area such as a park or a beach. In one example, the exercise machines may be owned by a public operator such as a municipality and be freely accessible to the population, which may advantageously contribute to improving the health and general well-being of the population. In another example, the exercise machines may be operated by an operator such as a municipality or a privately-owned company and be used by users in exchange for a fee. Since plain bearings are more resistant than other types of bearings to natural elements such as air and rain, this will advantageously reduce the costs associated with repairs or replacements of a damaged exercise machine.

According to another aspect, there is also provided a pivoting assembly for an exercise machine, the pivoting assembly comprising an axle, a first member mounted on the axle, a second member mounted on the axle, the second member being pivotable relative to the first member, and a first plain bearing element mounted on the axle between the first member and the second member to enable frictionless pivoting of the first member relative to the second member.

In one embodiment, the first plain bearing element is manufactured from a material having a low coefficient of friction selected from a group consisting of nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber and fiberglass.

In one embodiment, the first member comprises a first side surface extending perpendicularly to the axle; further wherein the second member having a second side surface parallel to the first surface and spaced therefrom, the first plain bearing element contacting the first side surface and the second side surface, the first plain bearing element being slidably movable relative to at least one of the first side surface and the second side surface.

In one embodiment, the first plain bearing element is disc-shaped.

In one embodiment, the second member comprises an elongated housing having a first end portion, a second end portion and a chamber extending between the first end portion and the second end portion for housing the axle.

In one embodiment, the first end portion comprises a first exterior planar surface defining the second side surface.

In one embodiment, the second end portion comprises a second exterior planar surface defining a third side surface.

In one embodiment, the pivoting assembly further comprises a holding member secured to the axle, the holding member being adjacent the second end portion of the housing for holding the housing between the holding member and the first member, the holding member having a fourth side surface facing towards the housing, and a second plain bearing element mounted between the holding member and the second end portion, the second plain bearing element contacting the third side surface and the fourth side surface to enable frictionless pivoting of the housing relative to the holding member.

In one embodiment, the exercise machine comprises one of an elliptical machine and a stationary bicycle.

BRIEF DESCRIPTION OF THE DRAWINGS

In order that the invention may be readily understood, embodiments of the invention are illustrated by way of example in the accompanying drawings.

Figure 1:
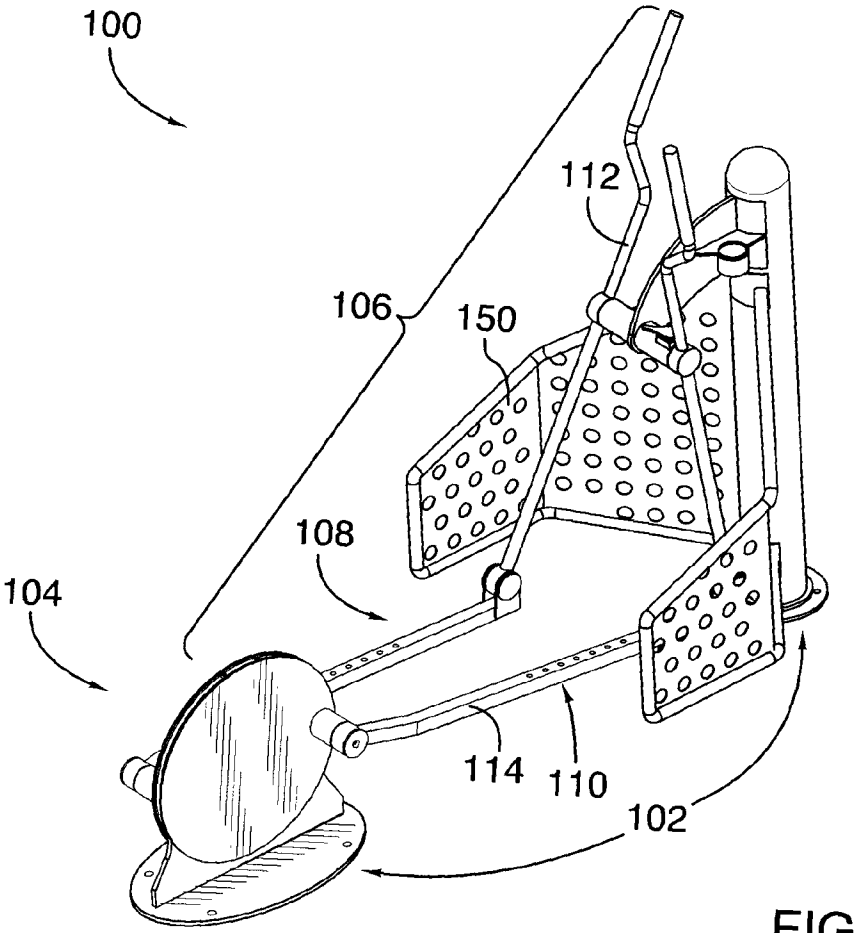
FIG. 1 is a drawing showing a rear perspective view of an exercise machine, in accordance with one embodiment.
Figure 2:
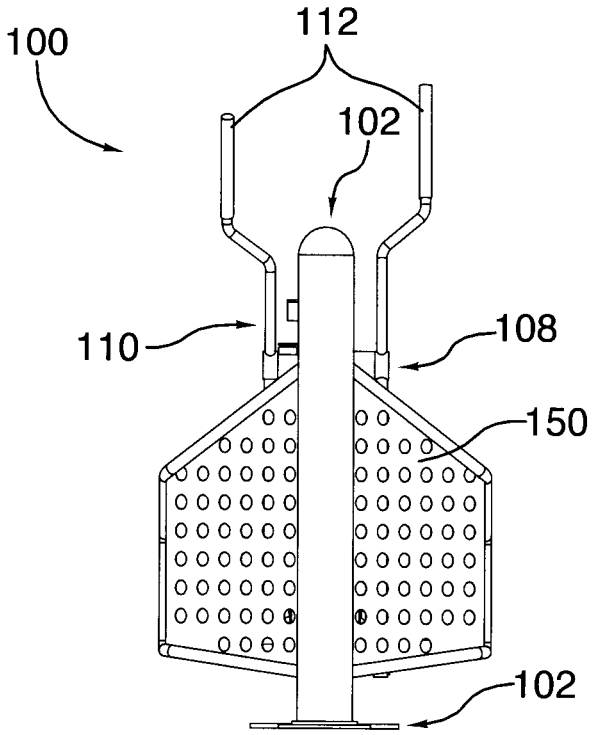
FIG. 2 is a drawing showing a front elevation view of the exercise machine shown in FIG. 1.
Figure 3:
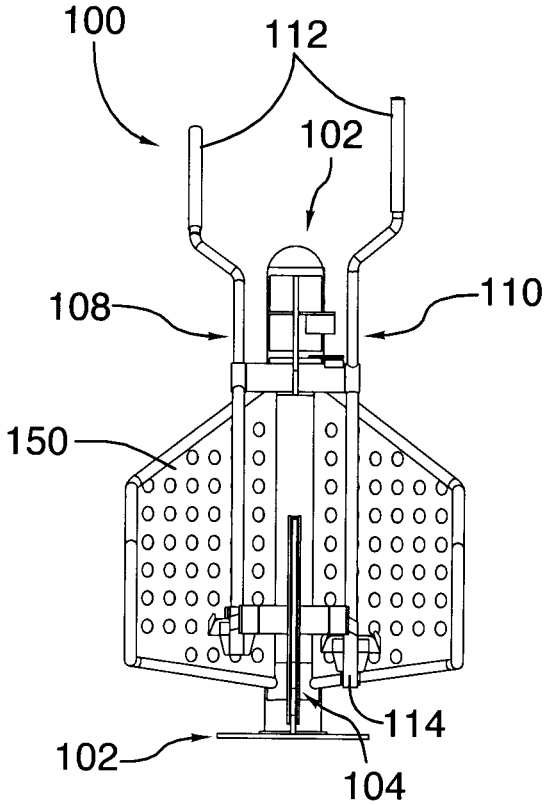
FIG. 3 is a drawing showing a rear elevation view of the exercise machine shown in FIG. 1.

Further details of the invention and its advantages will be apparent from the detailed description included below.

DETAILED DESCRIPTION

In the following description of the embodiments, references to the accompanying drawings are by way of illustration of an example by which the invention may be practiced. It will be understood that other embodiments may be made without departing from the scope of the invention disclosed.

Referring to FIGS. 1 to 6, there is provided an exercise machine 100, in accordance with one embodiment. In the illustrated embodiment, the exercise machine 100 is configured as an elliptical trainer. The exercise machine 100 comprises a frame 102, a wheel assembly 104 rotatably mounted to the frame 102 and an actuating assembly 106 operable by a user to urge rotation of the wheel assembly 104.

The actuating assembly 106 comprises a left actuating portion 108 adapted to be actuated using a left arm and/or a right leg of a user and a right actuating portion 110 adapted to be actuated using a right arm and/or a right leg of the user. Each one of the left and right actuating portions 108, 110 comprises a lever arm 112 pivotally connected to the frame 102 and a pedal member 114 pivotally connected to the lever arm 112 and to the wheel assembly 104 to enable the exercise machine 100 to substantially simulate a walking motion when the lever arms 112 are moved, as will become apparent below.

The frame 102 comprises a front frame portion 400 to which the levers arms 112 are pivotally connected and a rear frame portion 402 to which the wheel assembly 104 is rotatably mounted. In the illustrated embodiment, the front frame portion 400 comprises an elongated post member 404 extending upwardly from a ground surface 450, generally perpendicular thereto. More specifically, the elongated post member comprises a lower end 406 secured to the ground surface 450 and an opposed dome-shaped upper end 408.

Still in the illustrated embodiment, the lever arms 112 of the actuating assembly 106 are mounted to the front frame portion 400 via an arm mounting portion 410 extending generally rearwardly from the elongated post member 404, near the upper end 408 thereof. The arm mounting portion 410 comprises a fin-shaped, substantially flat central member 412 having a front end 414 secured to the post member 404 and a rear end 416 located near the user when the user is using the exercise machine 100. The arm mounting portion 410 further comprises a left hollow cylinder extending leftwardly from the rear end 416 of the central member 412 and a right hollow cylinder 502 extending rightwardly from the rear end 416 of the central member 412. The left hollow cylinder 500 is adapted to receive a left arm pivoting assembly 600 which enables the lever arm 112 of the left actuating portion 108 to pivot relative to the frame 102. Similarly, the right hollow cylinder 502 is adapted to receive a right arm pivoting assembly 602 which enables the lever arm 112 of the right actuating portion 110 to pivot relative to the frame 102. The left and right hollow cylinders 500, 502 are aligned with each other and define a generally horizontal arm pivoting axis $P_1$ of the lever arms 112, as will become apparent below.

Figure 10:
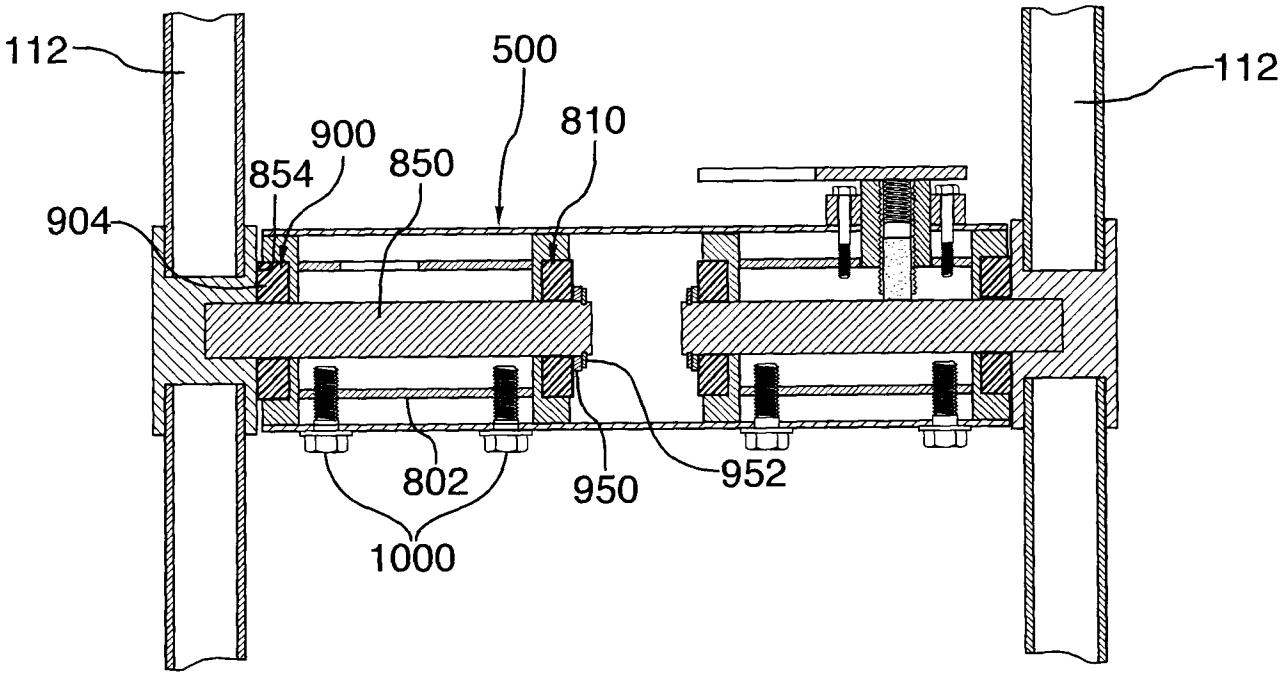
FIG. 10 is a drawing showing a cross-section view of the left and right arm pivoting assemblies for the exercise machine shown in FIG. 1.

In one embodiment, the left and right hollow cylinders 500, 502 form a single, monolithic tube having a left end defining the left hollow cylinder 500 and a right end defining the right hollow cylinder 502, as best shown in FIG. 10. Alternatively, the left and right hollow cylinders 500, 502 may instead be provided as two distinct pieces.

The arm mounting portion 410 may further be provided with a cup holder 420 for holding a beverage or with any other container to enable the user to keep item within reach during exercising.

Still referring to FIGS. 1 to 6, the rear frame portion 402 comprises a flat, generally elliptical base 504 for securing the rear frame portion 402 to the ground surface 450 and a wheel mounting member 604 extending upwardly therefrom, generally perpendicularly thereto. In the illustrated embodiment, the wheel mounting member 604 is relatively thin and comprises a generally circular upper portion 606 and a lower support portion 608 tapering inwardly between the base 504 and the upper portion 606 for supporting the upper portion 606 and the wheel assembly 104 mounted thereto. The upper portion 606 has a circular outer edge 610, a central opening 612 for receiving an axle mounting assembly 614, best shown in FIG. 7, and an elongated, generally rectangular indent 616 extending between the outer edge 610 and the central opening 612 to enable assembly of the wheel assembly 104, as will become apparent below.

In one embodiment, the front and rear frame portions 400, 402 are secured to the ground surface 450 using securing means known to the skilled addressee such as anchor bolts or the like.

While in the illustrated embodiment, the front and rear frame portions 400, 402 are provided as two distinct, spaced apart pieces, the frame 102 may instead comprise a single, integral piece having a front end defining the front frame portion and a rear end defining the rear frame portion.

Still referring to FIGS. 1 to 6, the actuating assembly 106 will now be described. Since the left and right actuating portions 108, 110 are similar to each other, only the right actuating portion 110 will be described. The skilled addressee will appreciate that the same description also applies for the left actuating portion 108.

The lever arm 112 of the right actuating portion 110 comprises an upper end 618 which defines a handle 620 and an opposed lower end 622. The pedal member 114 of the right actuating portion 110 is generally elongated and comprises a front end 624 pivotally connected to the lower end 622 of the lever arm 112 and an opposed rear end 626 pivotally connected to the wheel assembly 104. More specifically, the lower end 622 of the lever arm 112 comprises a cylindrical sleeve 628 defining a central bore 630 adapted for receiving a cylindrical plain bearing, not shown. The front end 624 of the pedal member 114 comprises a pair of spaced apart parallel tabs 632 extending generally upwardly. The cylindrical sleeve 628 is received between the spaced apart tabs 632 to enable pivoting of the lever arm 112 relative to the pedal member 114 about a generally horizontal pivot axis $P_2$. A pair of disc-shaped caps 634 are further provided on both sides of the spaced apart tabs 632 and are fastened to the plain bearing element through the spaced apart tabs 632.

In one embodiment, the cylindrical plain bearing and the spaced apart tabs 632 are manufactured from a material having a relatively low coefficient of friction such as nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber, fiberglass or the like to further facilitate rotation of the wheel assembly. In a preferred embodiment, the plain bearing and the spaced apart tabs 632 are manufactured from nylon.

This configuration enables frictionless pivoting of the cylindrical sleeve 628 relative to the spaced apart tabs 632. It will be appreciated that the term "frictionless" is used herein to described reduced friction between two or more moving parts, and that some friction may still be present between theses two or more moving parts.

Now referring to FIGS. 1 to 6 and 13, the right actuating portion 110 further comprises a foot receiving member 506 adapted to receive a right foot of the user. In one embodiment, the foot receiving member 506 comprises a tray 1300 sized and shaped to receive the right foot of the user and a pedal mounting mechanism 1302 for removably securing the tray 1300 to the pedal member 114 and also enabling adjustment of the position of the tray on the pedal member 114. More specifically, the pedal mounting mechanism 1302 comprises an elongated, generally rectangular plate 1304 having a rear end 1305 and an opposed front end 1307. At the front end 1307, a horseshoe-shaped first panel 1306 extends downwardly, generally perpendicularly to the rectangular plate 1304. The first panel 1306 defines an elongated, generally rectangular first indent 1308 having an open bottom end 1310 and a upper inner edge 1312 located opposite the open bottom end 1310. The open bottom end 1310 enables the first panel 1306 to be inserted over the pedal member 114 during assembly of the pedal mounting mechanism 1302, such that the pedal member 114 enters the first indent 1308 through its open bottom end 1310.

The pedal mounting mechanism 1302 further comprises a horseshoe-shaped second panel 1314 which is similar to the first panel 1306, but inverted. More specifically, the second panel 1314 defines an elongated, generally rectangular second indent 1316 having an open top end 1318 and a lower inner edge 1320 located opposite the open top end 1318. The open top end 1318 enables the second panel 1314 to be inserted around the pedal member 114 from underneath during assembly of the pedal mounting mechanism 1302, such that the pedal member 114 enters the second indent 1316 through its open top end 1318.

The pedal mounting mechanism 1302 further comprises a positioning pin 1321 extending downwardly from the rear end 1305 of the rectangular plate 1304 to engage a plurality of spaced apart, upwardly facing positioning holes 650 defined on the pedal member 114. The positioning holes 650 enable the foot receiving member 506 to be selectively moved frontwardly and rearwardly to accommodate the user, as a person skilled in the art will appreciate. This is particularly advantageous when the exercise machine 100 is part of a public exercising program and is used by various users, in which case the foot receiving member 506 may be positioned according to the morphology of a particular user.

When the first and second panels 1306, 1314 are assembled using, for instance, fasteners such as rivet fasteners or the like, the first and second indents 1308, 1316 define a generally rectangular opening which is sized and shaped to receive the panel member 114, but which is slightly more elongated than the cross-section of the panel member 114. In this configuration, the foot receiving member 506 may be lifted to disengage the positioning pin 1321 from one of the positioning holes 650 and may be slid forward or rearward to adjust its position. Once a desired position has been attained, the positioning pin 1321 may then be inserted in a corresponding one of the positioning holes 650 and is prevented from being disengaged therefrom during exercising by the weight of the user whose foot is received in the foot receiving member 506.

Generally horseshoe-shaped upper and lower guard members 1322, 1324 are also provided between the first and second panels 1306, 1314 and are sandwiched therebetween when the pedal mounting mechanism 1302 is assembled. A generally rectangular upper indent 1326 is defined in the upper guard member 1322, the indent 1326 having an open bottom end 1328 and an upper inner edge 1330. When the pedal mounting mechanism 1302 is assembled, the upper inner edge 1330 of the upper guard member 1322 is positioned lower than the upper inner edge 1312 of the first panel 1306. According to this configuration, the upper inner edge 1330 of the upper guard member 1322 contacts the pedal member 114 during exercise, which prevents the upper inner edge 1312 of the first panel 1306 to be damaged by contacting the pedal member 114.

Similarly, a generally rectangular lower indent 1332 is defined in the lower guard member 1324, the indent 1332 having an open top end 1334 and a lower inner edge 1336. When the pedal mounting mechanism 1302 is assembled, the lower inner edge 1336 of the lower guard member 1324 is positioned higher than the lower inner edge 1320 of the second panel 1314. According to this configuration, the lower inner edge 1336 of the lower guard member 1324 prevents the lower inner edge 1320 of the second panel 1314 to be damaged by contacting the pedal member 114 when the foot receiving member 506 is lifted for adjustment.

In one embodiment, the upper and lower spacers 1322, 1324 are manufactured from a material having a relatively low coefficient of friction such as nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber, fiberglass or the like to further facilitate rotation of the wheel assembly. In a preferred embodiment, the upper and lower spacers 1322, 1324 are manufactured from nylon.

Figure 4:
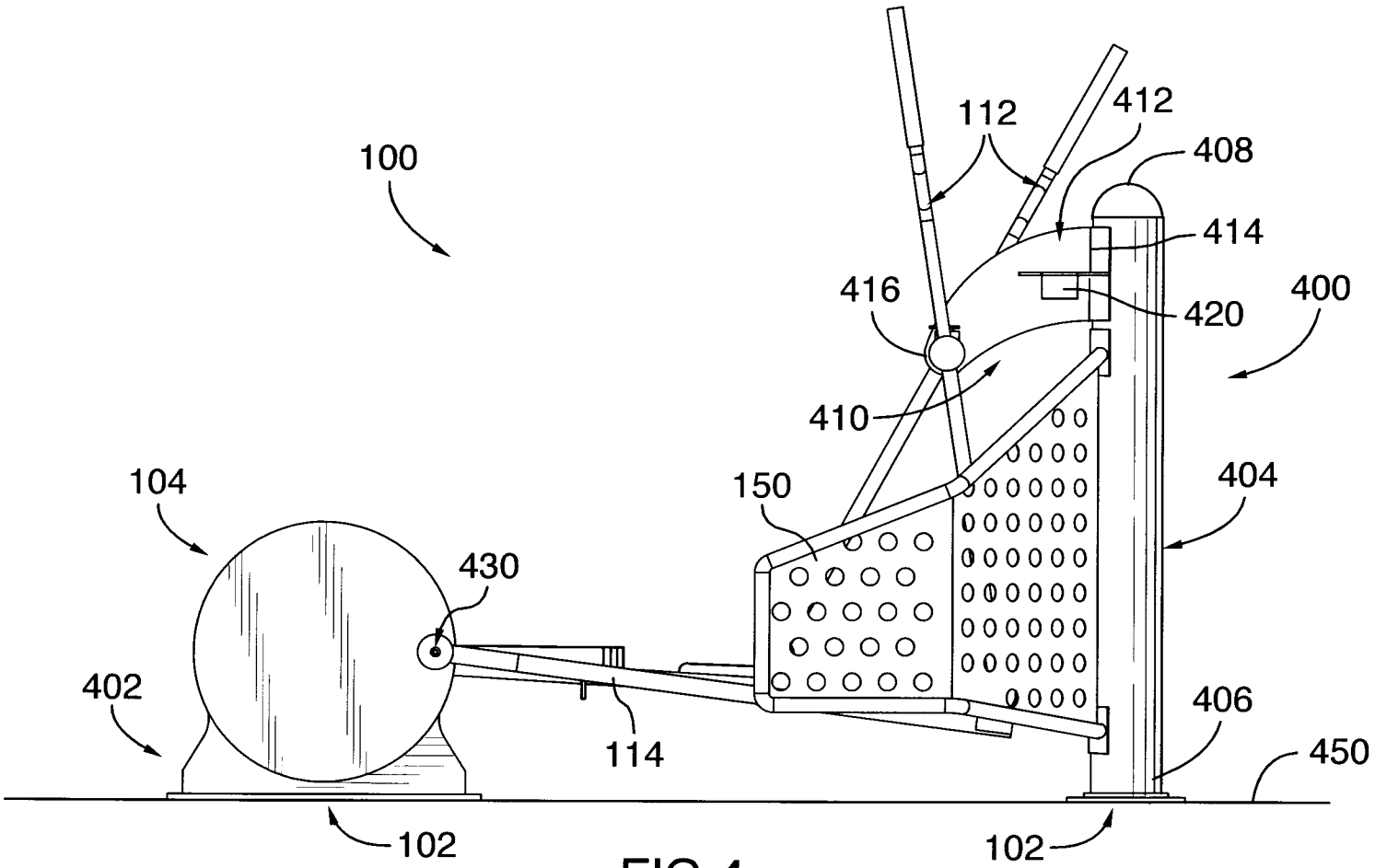
FIG. 4 is a drawing showing a right side elevation view of the exercise machine shown in FIG. 1.
Figure 5:
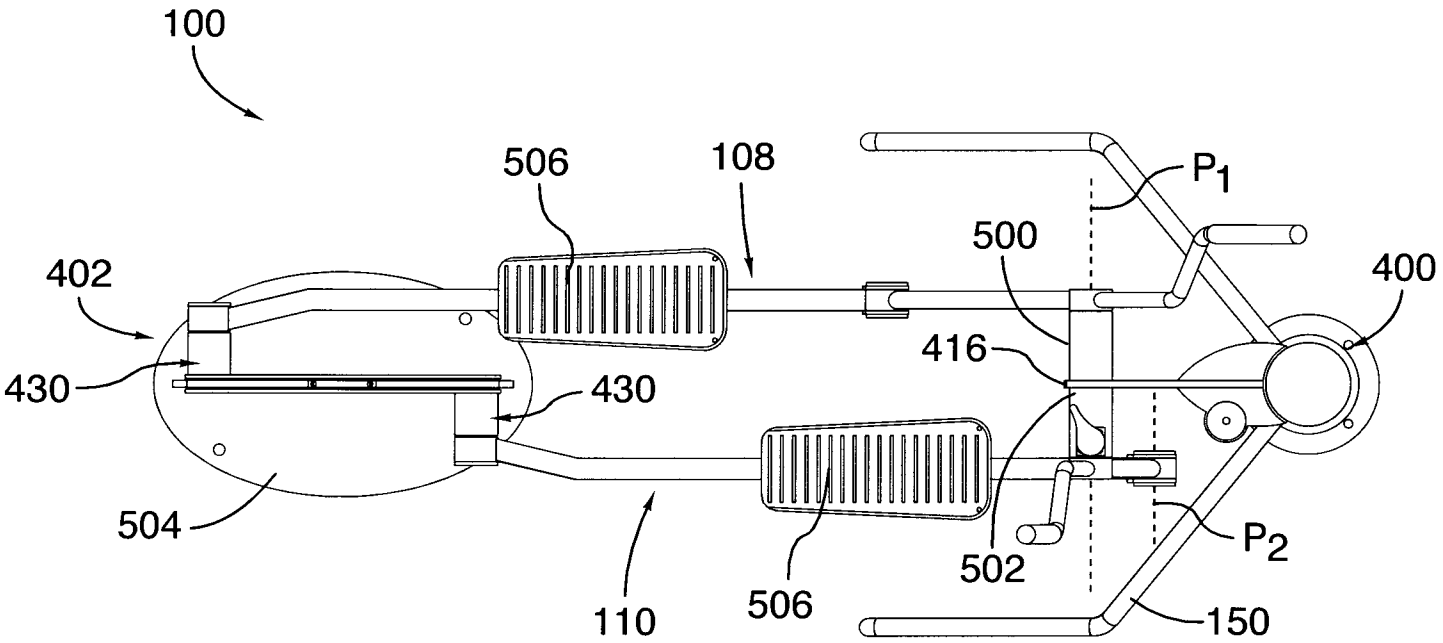
FIG. 5 is a drawing showing a top plan view of the exercise machine shown in FIG. 1.
Figure 6:
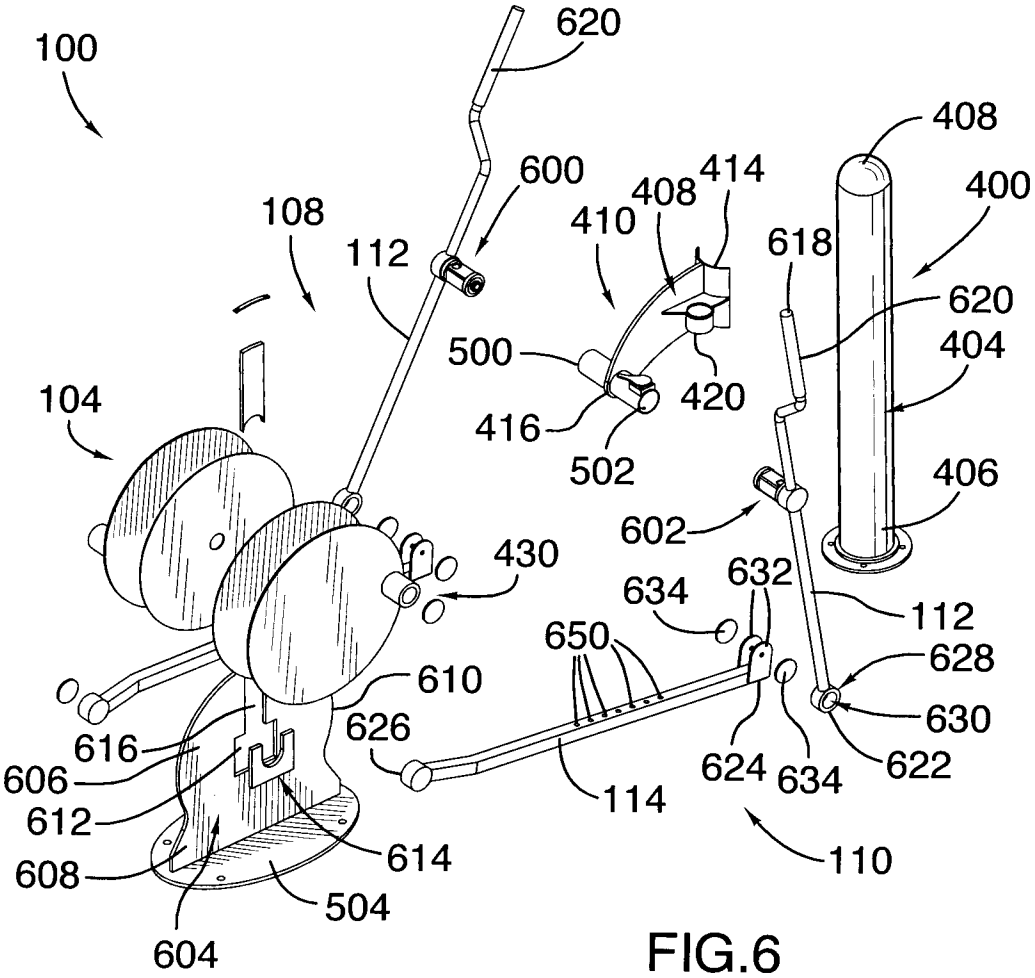
FIG. 6 is a drawing showing an exploded view of the exercise machine shown in FIG. 1, with the barrier removed.

Referring now to FIGS. 1 to 6, the rear end 626 of the pedal member 114 is pivotally connected to the wheel assembly 104 via a rear pivoting assembly 430 which is located eccentrically relative to the wheel assembly 104, as best shown in FIG. 4. Furthermore, the rear pivoting assembly 430 of the left actuating portion 108 is also located eccentrically relative to the wheel assembly 104 and is diametrically opposed to the rear pivoting assembly 430 of the right actuating portion 110, as best shown in FIG. 5. The skilled addressee will appreciate that this configuration enables the feet of the user received on the foot receiving portions 506 to move along a generally elliptical path which simulates a walking motion when the wheel assembly 104 is rotated. As the feet of the user move along this elliptical path, the pedal members 114 also move back and forth and the lever arms 112, which are connected to the pedal members 114, pivot about the arm pivoting axis $P_1$. This configuration enables the user holding the handles 620 and having his feet received in the foot receiving portions 506 to simultaneously exercise his arms and his legs when actuating the exercise machine 100.

In the illustrated embodiment, the exercise machine 100 is further provided with a barrier 150 which extends rearwardly from the front frame portion 400 and on both sides of the user when the user uses the exercise machine 100. The barrier 150 advantageously prevents object from interfering with the movement of the actuating assembly 106. The barrier 150 may further prevent children from passing between the lever arms 112 and the front frame portion 400 when the exercise machine 100 is in use and from thereby getting hurt.

Figure 7A:
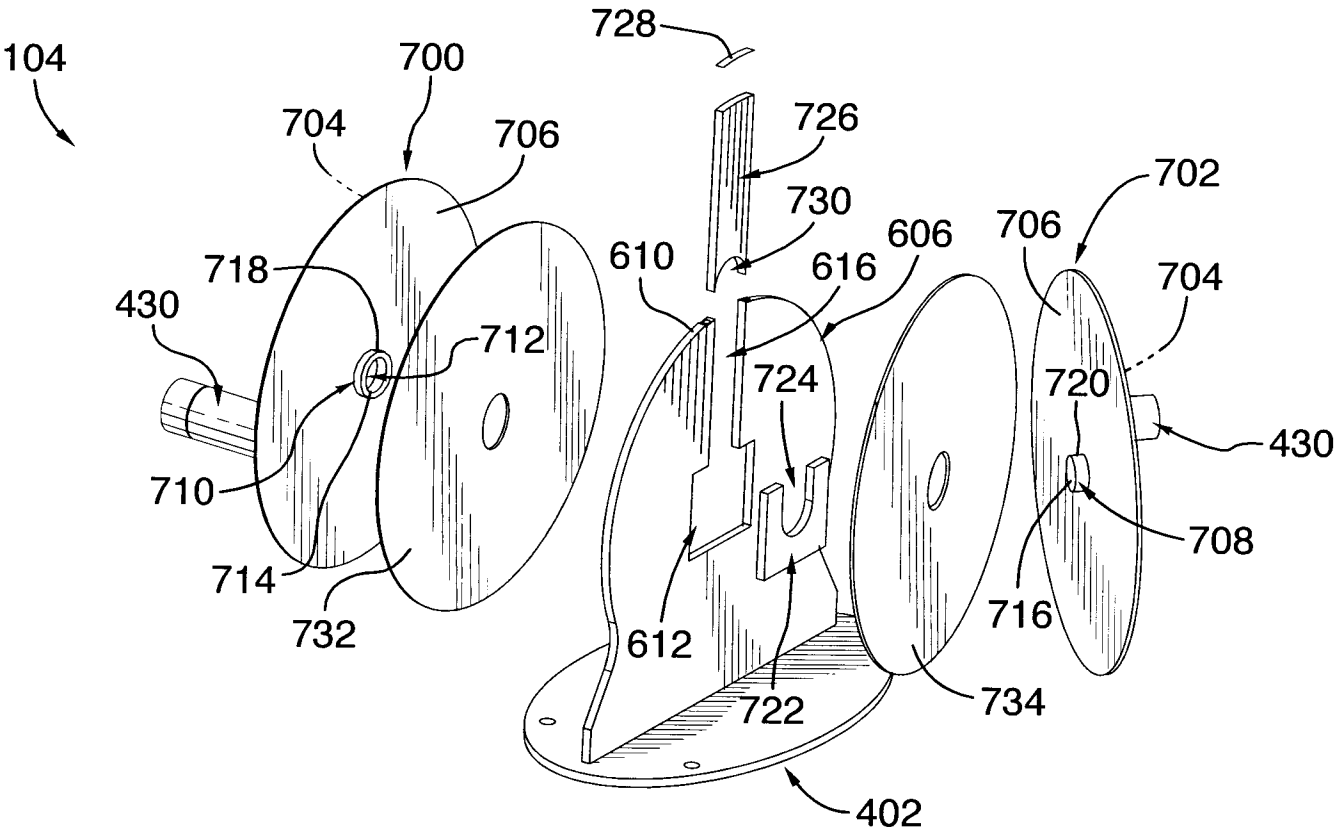
FIG. 7A is a drawing showing an exploded view of a wheel assembly for the exercise machine shown in FIG. 1.
Figure 7B:
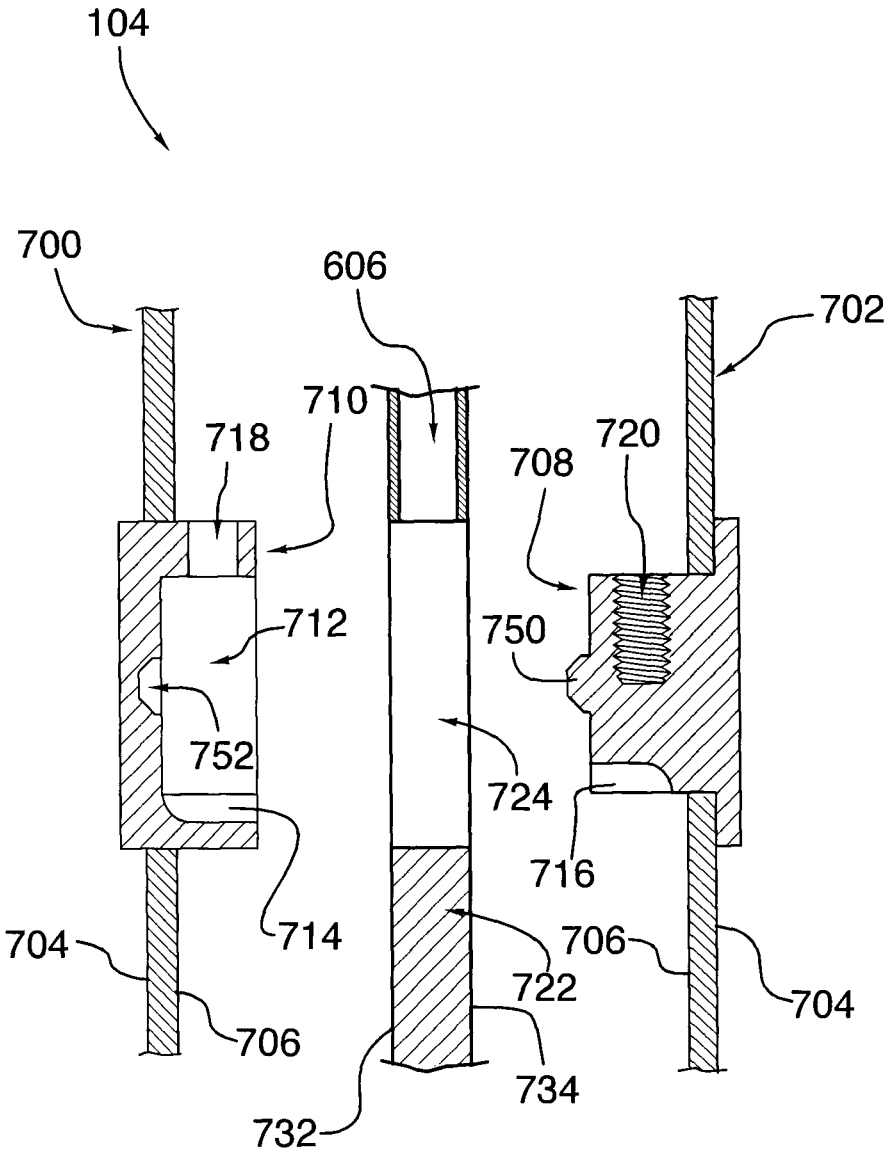
FIG. 7B is a drawing showing a cross-section view of the wheel assembly shown in FIG. 7A, partially exploded and with the left and right spacers mounted to the wheel mounting member.

Now referring to FIGS. 7A and 7B, there is shown the wheel assembly 104, in accordance with one embodiment. The wheel assembly 104 has a generally layered configuration and comprises disc-shaped left and right outer wheel portions 700, 702 interconnected by an axle extending through the central opening 612 of the rear frame portion 402.

In the illustrated embodiment, each one of the left and right outer wheel portions 700, 702 is relatively thin and comprises an outer surface 704 to which are connected the rear pivot assemblies 430 and an opposed inner surface 706. Still in this embodiment, the axle comprises first and second axle elements interconnected together to facilitate assembly of the wheel assembly, as will become apparent below. More specifically, the right outer wheel portion 702 comprises a generally cylindrical protrusion 708 extending away from the inner surface 706, at the center thereof. The left outer wheel portion comprises a generally cylindrical wall 710 extending away from the inner surface 706, also at the center thereof, which defines a cylindrical cavity 712 sized and shaped for snuggly receiving the cylindrical protrusion 708 to thereby form the axle. Alternatively, the cylindrical protrusion 708 may instead be provided on the left outer wheel portion 700 and the cylindrical wall 710 may instead be provided on the right outer wheel portion 702.

A centering nipple 750 may further be provided on the protrusion 708, at the center thereof, for engaging a nipple receiving cavity 752 provided in the cylindrical cavity 712, also at the center thereof. This configuration advantageously contributes to maintaining the protrusion 708 and cylindrical wall 710 are in axial alignment during rotation of the wheel assembly 104. Alternatively, the centering nipple 750 may instead be provided in the cylindrical cavity 712 and the nipple receiving cavity 752 may instead be defined in the protrusion 708.

To prevent rotation of the left outer wheel portion 700 relative to the right outer wheel portion 702, the cylindrical protrusion 708 may engage the cylindrical cavity 712 in an interference fit configuration. Alternatively and/or additionally, the cylindrical cavity 712 may comprise a keyway 714 and the cylindrical protrusion 708 may comprise a corresponding key 716 which is received in the keyway 714 when the cylindrical protrusion 708 is received in the cylindrical cavity 712, thereby preventing rotation of the left outer wheel portion 700 relative to the right outer wheel portion 702.

To further prevent rotation of the left outer wheel portion 700 relative to the right outer wheel portion 702 as well as to maintain the cylindrical protrusion 708 engaged in the cylindrical cavity 712, a fastener, not shown, may be provided. The fastener extends through a first hole 718 defined in the cylindrical wall 710 of the left outer wheel portion 700 and further through a second hole 720 defined in the cylindrical protrusion 708 of the right outer wheel portion 702.

Still referring to FIGS. 7A and 7B, the axle mounting assembly 614 is adapted for securing the axle to the rear frame portion 402 relatively easily. The axle mounting assembly 614 comprises a generally square central plate 722 having a U-shaped indent 724 defined therein. The central plate 722 is sized and shaped to snuggly fit in the central opening 612 of the rear frame portion 402, with the U-shaped indent 724 facing upwardly towards the elongated indent 616 of the rear frame portion 402. The axle mounting assembly 614 further comprises an elongated panel 726 sized and shaped to be slidably inserted in the elongated indent 616 and a locking strip 728 fastened to the circular edge 610 of the rear frame portion 402, over the elongated indent 616, to prevent unwanted removal of the elongated panel 726 installed in the elongated indent 616.

A concave indent 730 is defined in the elongated panel 726 and faces downwardly when the elongated panel 726 is installed in the elongated recess 616. The concave indent 730 of the elongated panel and the U-shaped indent 724 of the central plate 722 together define a circular opening which is sized and shaped to receive the axle. The circular opening may have a diameter which is slightly greater than the diameter of the axle to enable substantially smooth rotation of the wheel assembly 104.

In this configuration, the central plate 722 and the elongated panel 726 act as a plain bearing to facilitate the rotation of the wheel assembly 104 relative to the rear frame portion 402. In one embodiment, the central plate 722 and the elongated panel 726 are manufactured from a material having a relatively low coefficient of friction such as nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber, fiberglass or the like to further facilitate rotation of the wheel assembly. In a preferred embodiment, the central plate 722 and the elongated panel 726 are manufactured from nylon.

The wheel assembly 104 further comprises a left spacer 732 sandwiched between the left outer wheel portion 700 and the upper portion 606 of the rear frame portion 402 and a right spacer 734 sandwiched between the right outer wheel portion 702 and the upper portion 606 of the rear frame 402. In the illustrated embodiment, the left and right spacers 732, 734 are disc-shaped and are sized similarly to the left and right outer wheel portions 700, 702 to prevent the left and right outer wheel portions 700, 702 from bending inwardly towards the rear frame portion 402. This advantageously enables the left and right outer wheel portions 700, 702 to remain parallel to each other during rotation of the wheel assembly 104.

In one embodiment, the left and right spacers 732, 734 are manufactured from a material having a relatively low coefficient of friction such as nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber, fiberglass or the like to further facilitate rotation of the wheel assembly. In a preferred embodiment, the left and right spacers 732, 734 are manufactured from nylon.

To assemble the wheel assembly 104, the central plate 722 is first inserted in the central opening 612 of the rear frame portion 402 with the U-shaped indent 724 facing upwardly. The left spacer 732 is placed against the inner surface 706 of the left outer wheel portion 700 and the right spacer 734 is placed against the inner surface 706 of the right outer wheel portion 702. The central protrusion 708 of the right wheel portion 702 is then inserted in the cylindrical cavity 712 of the left wheel portion 700 through the central opening 612 of the rear frame portion 402, the key 716 being received in the corresponding keyway 714 and the first hole 718 of the cylindrical wall 710 being aligned with the second hole 720 of the cylindrical protrusion 708. The left and right wheel portions 700, 702 are positioned such that the first hole 718 is accessible from above through the elongated recess 616 and the fastener, not shown, is inserted in the first and second holes 718, 720. The elongated panel 726 is then inserted in the elongated recess 616 until the concave indent 730 abuts the cylindrical wall 710. The locking strip 728 may then be fastened over the elongated panel 726 using one or more security screws or other tamper-resistant fasteners known to the skilled addressee, which advantageously prevent unwanted removal of the elongated panel 726 from the elongated recess 616 and unwanted disassembly of the wheel assembly 104. This is particularly advantageous to prevent vandalism when the exercise machine 100 is used in a public area.

It will be appreciated that this configuration provides a wheel assembly 104 which is relatively compact and easy to assemble. The wheel assembly 104 is also relatively easy and cheap to manufacture since it comprises relatively few parts.

Figure 8:
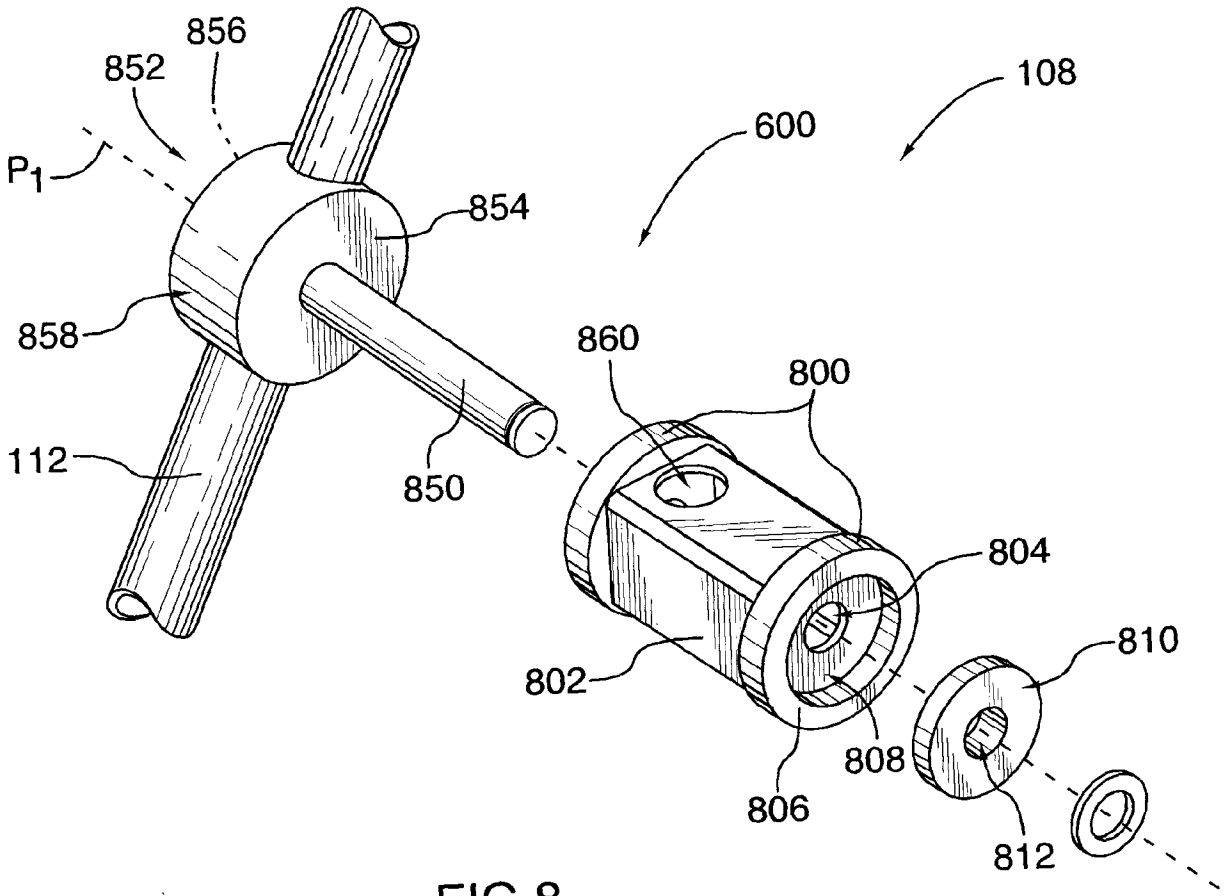
FIG. 8 is a drawing showing an exploded view of a left arm pivoting assembly for the exercise machine shown in FIG. 1.
Figure 9:
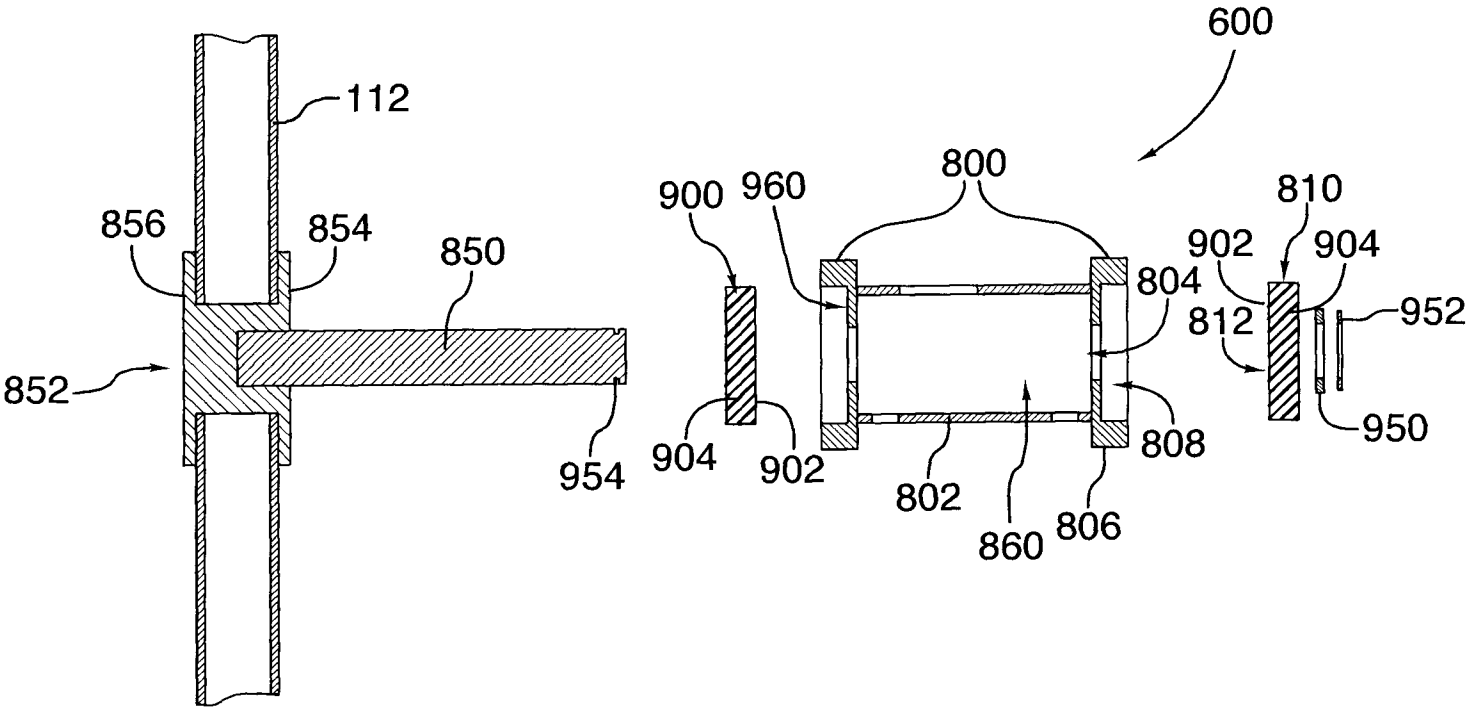
FIG. 9 is a drawing showing a cross-section view, partially exploded, of the left and right arm pivoting assemblies shown in FIG. 8.

Now referring to FIGS. 8 to 10, the left and right arm pivoting assemblies 600, 602 will now be described. Since the left and right arm pivoting assemblies 600, 602 are substantially similar, only the left arm pivoting assembly 600 will be described.

The left arm pivoting assembly 600 comprises a housing or sleeve 802 having first and second end portions defining a pair of spaced apart bearing receiving members 800, or first members, between which extends a chamber 860. In the illustrated embodiment, the sleeve 802 is elongated and has a generally rectangular cross-section, but may instead be cylindrical or have any other shape which a skilled addressee would deem suitable. Each one of the bearing receiving members 800 comprises a central opening 804 and an annular sidewall 806 defining a cylindrical recess 808 sized and shaped for receiving one of first and second cylindrical plain bearings 900, 810 therein. Each one of the bearing receiving members 800 also comprises a first side surface, or exterior planar surface 960. Each one of the first and second plain bearings 900, 810 comprises an inner face 902 contacting the exterior planar surface 960 of the bearing receiving member 800 and an outer face 904 spaced from the inner face 902 and extending parallel thereto. Each one of the first and second plain bearings 900, 810 also comprises a central bearing opening 812 sized and shaped to fit around an axle or shaft 850 mounted to the lever arm 112 of the left actuating portion 108 via a second member, or shaft mounting member 852.

In the illustrated embodiment, the shaft mounting member 852 has a generally cylindrical configuration and comprises a second side surface, or inner circular face 854, and an outer circular face 856 which is parallel to the inner circular face 854. The shaft mounting member 852 further comprises an annular side face 858 extending between the inner circular face 854 and the outer circular face 856. The shaft 850 extends from the inner circular face 854, perpendicularly thereto, towards the right actuating portion 110.

When the left and right arm pivoting assemblies 600, 602 are properly assembled, the shaft 850 engages the central opening 804 of the bearing receiving member 800 such that the exterior planar surface 960 of the bearing receiving member 800 is perpendicular to the shaft and such that the inner circular face 854 of the shaft mounting member 852 is parallel to the exterior planar surface 960. In this configuration, the first and second plain bearings 900, 810 contact the shaft 850 and therefore facilitate pivoting of the lever arm 112 about the arm pivoting axis $P_1$. Furthermore, the outer face 904 of the first plain bearing 900 contacts the inner face 854 of the shaft mounting member 852 and the exterior planar surface 960 of the bearing receiving member 800 with relatively little friction, which further facilitates pivoting of the lever arm 112 about the arm pivoting axis $P_1$.

In one embodiment, the plain bearings 900, 810 are manufactured from a material having a relatively low coefficient of friction such as nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber, fiberglass or the like to further facilitate rotation of the wheel assembly. In a preferred embodiment, the plain bearings 900, 810 are manufactured from nylon.

It will further be appreciated that since the first and second plain bearings 900, 810 are spaced apart, the shaft 850 is able to withstand greater bending loads, such as loads caused by the force applied by the user on the handles during exercise, without deforming, which is of great advantage.

To assemble the arm pivoting assembly 600, the first and second plain bearings 900, 810 are first inserted in their respective bearing receiving members 800. The shaft 850 is then inserted inside the central bearing opening 812 of the first and second plain bearings 900, 810. A holding member, or washer 950, is then placed on the shaft 850, adjacent the second plain bearing 810 and a retaining ring or circlip 952 is placed on the shaft 850 adjacent the washer 950 and is engaged in a corresponding groove 954 of the shaft 850. The entire arm pivoting assembly 600 is then inserted into the left hollow cylinder 500 and is fastened thereto using fasteners such as bolts 1000 or the like. The bolts 1000 engage both the left hollow cylinder 500 and the sleeve 802 to prevent the sleeve 802 from pivoting relative to the left hollow cylinder 500.

Figure 11:
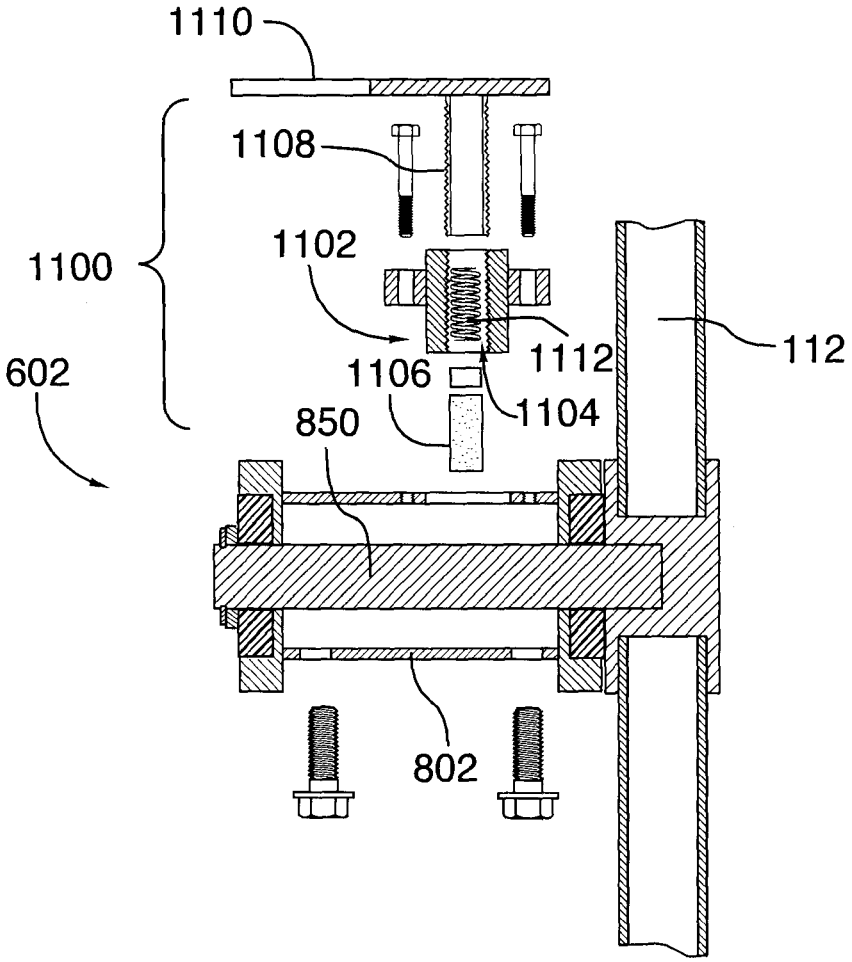
FIG. 11 is a drawing showing a cross-section view, partially exploded, of the resistance setting mechanism shown in FIG. 10.

Now turning to FIG. 11, there is shown the right arm pivoting assembly 602, which is substantially similar to the left arm pivoting assembly 600. However, the right arm pivoting assembly 602 further comprises a resistance setting mechanism 1100 which enables the user to adjust a resistant force exerted by the exercise machine against the force applied by the user. In the illustrated embodiment, the resistance setting mechanism 1000 comprises a cylinder 1102 having a threaded bore 1104 in communication with the sleeve 802 and a cylindrical abutment member 1106 slidably received in the threaded bore 1104.

The cylindrical abutment member 1106 is manufactured from a material having a relatively high friction coefficient such as rubber or the like. The resistance setting mechanism 1100 further comprises a threaded cylindrical pushing member 1108 having a handle 1110 and a spring 1112 located between the pushing member 1108 and the abutment member 1106. By turning the handle 1110 in a first direction, the pushing member 1108 is screwed into the threaded bore 1104 and compresses the spring 1112 which pushes the abutment member 1106 on the shaft 850 to impede pivoting of the shaft 850 relative to the sleeve 852 by friction, thereby increasing resistance against the force applied by the user. By turning the handle 1110 in a second direction opposed to the first direction, the pushing member 1108 is unscrewed from the threaded bore 1104 and the spring 1112 is depressed, which relieves pressure on the abutment member 1106, thereby decreasing resistance against the force applied by the user.

Alternatively, the resistance setting mechanism 1100 may be located on another part of the exercise machine 100. For instance, the resistance setting mechanism 1100 may be integrated to the wheel assembly 104. The resistance setting mechanism 1100 may also use magnetism instead of friction to create resistance, or may be one of various other resistance setting mechanism known to the skilled addressee. In yet another embodiment, the exercise machine 100 may not comprise a resistance setting mechanism 1100 at all.

Figure 12:
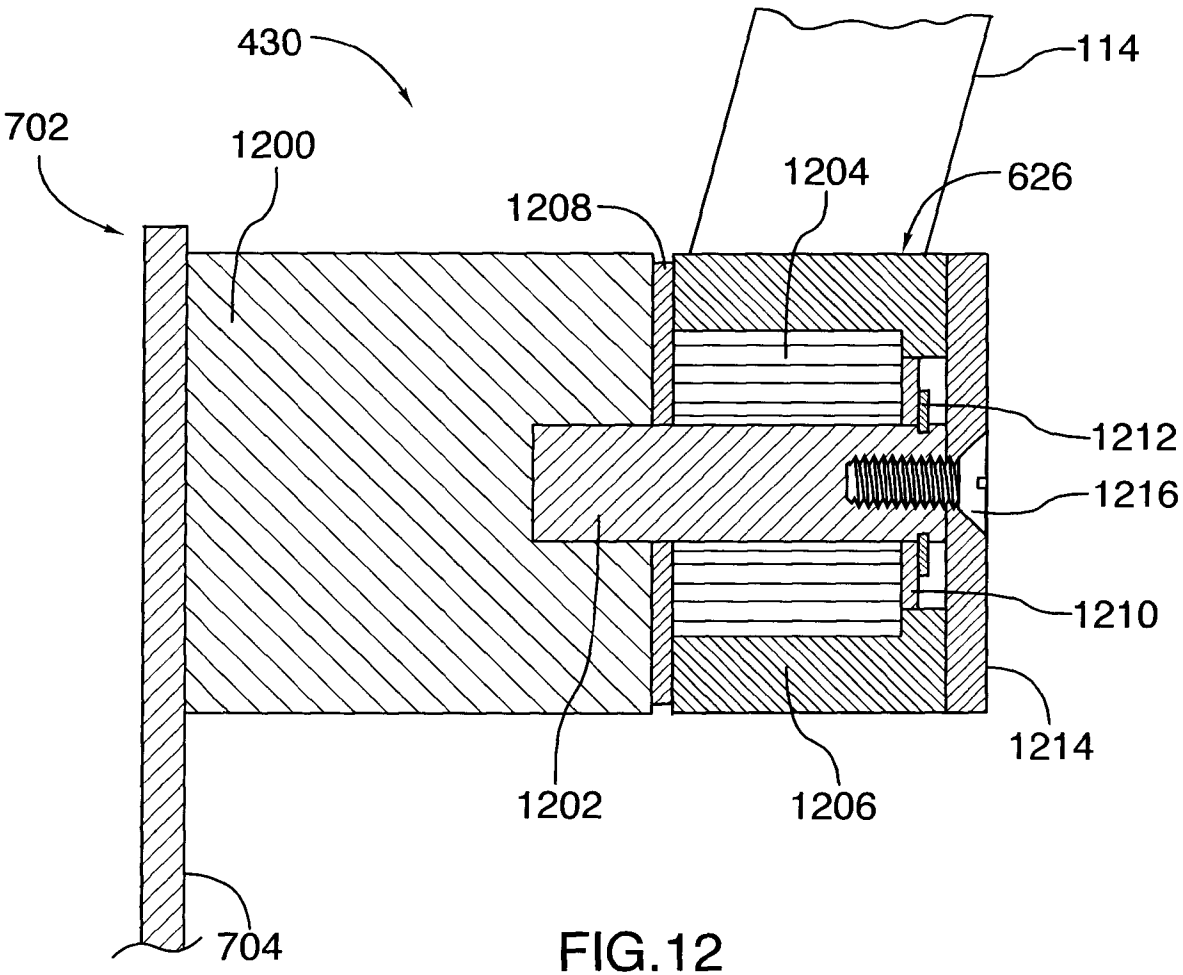
FIG. 12 is a drawing showing a cross-section view of the rear pivoting assembly for the exercise machine shown in FIG. 1.
Figure 13:
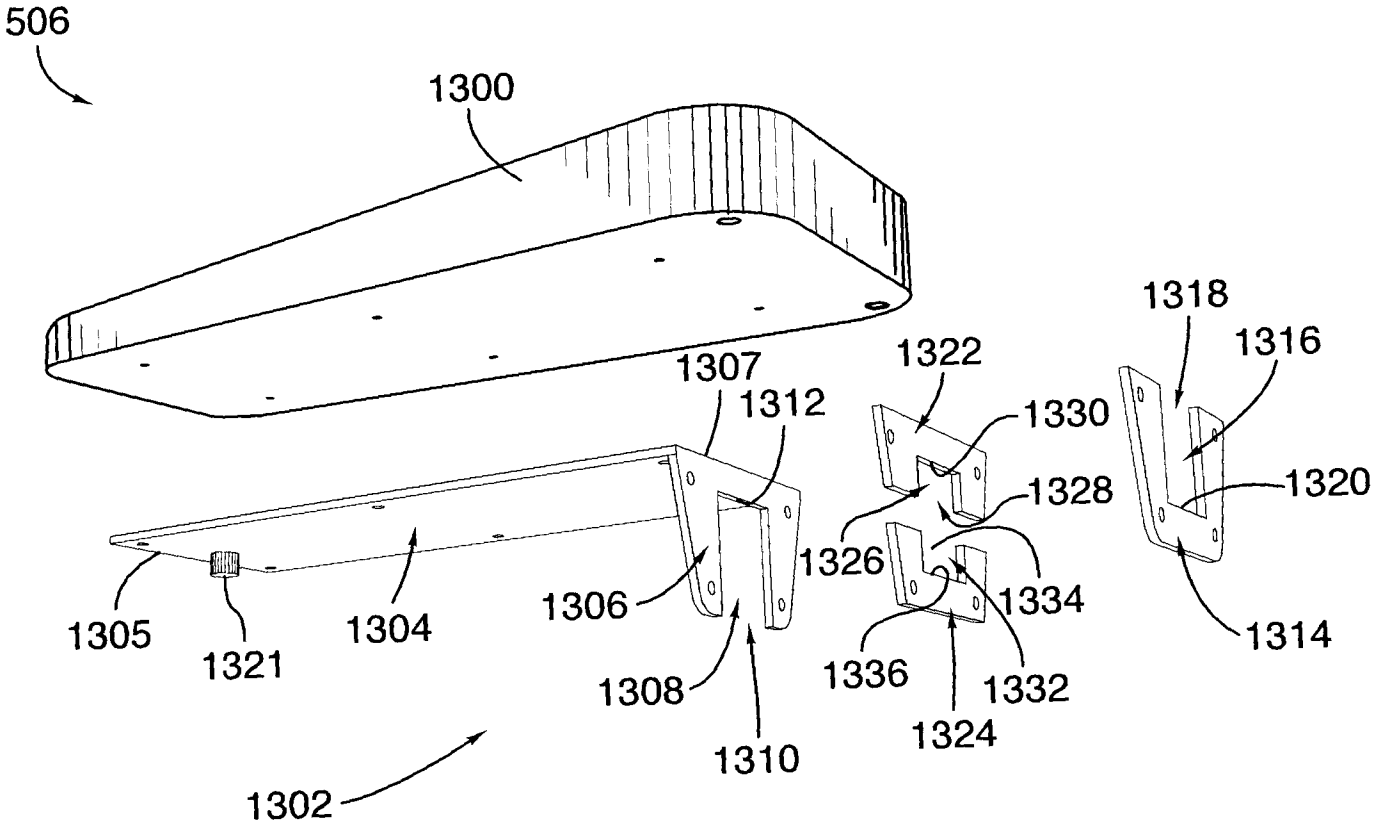
FIG. 13 is a drawing showing a bottom front perspective view of a foot receiving member for the exercise machine shown in FIG. 1.

With reference to FIG. 12, the rear pivoting assembly 430 will now be described. The rear pivoting assembly 430 comprises a cylindrical base 1200 extending outwardly from the outer surface of one of the left and right outer wheel portions 700, 702, and more precisely of the right outer wheel portion 702 in FIG. 12. The rear pivoting assembly 430 further comprises a pivot pin 1202 extending outwardly from the cylindrical base 1200, substantially parallel thereto, and an annular plain bearing 1204 fitted around the pivot pin 1202. The rear end of the pedal member 114 defines an annular sleeve 1206 which is slidably engaged on the pivot pin 1202, over the annular plain bearing 1204. The rear pivoting assembly 430 further comprises a spacer disc 1208 engaged on the pivot pin 1202, between the cylindrical base 1200 and the annular sleeve 1206, to facilitate pivoting of the annular sleeve 1206 relative to the cylindrical base 1200. To secure the annular plain bearing 1204 to the pivot pin 1202, a washer 1210 and a retaining ring or circlip 1212 are provided, and a disc-shaped cap 1214 is secured over the annular sleeve 1206 using a fastener 1216. In one embodiment, the fastener 1216 is a security flat head fastener 1216, which advantageously prevents unwanted disassembly of the rear pivoting assembly 430 by someone other than an operator or manufacturer of the exercise machine 100.

In one embodiment, the annular plain bearing 1204 and the spacer disc 1208 are manufactured from a material having a relatively low coefficient of friction such as nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber, fiberglass or the like to further facilitate rotation of the wheel assembly. In a preferred embodiment, the annular plain bearing 1204 and the spacer disc 1208 are manufactured from nylon.

From the foregoing description, it will be appreciated that the exercise machine 100 does not comprise any roller bearing or ball bearing, which may get damaged by infiltrations of dirt and/or water. Instead, movement of the parts relative to each other is facilitated by the use of one or more plain bearings manufactured from materials having relatively low friction coefficient. This type of bearings further eliminates the need for enclosure such as a ball bearing cage in which dirt and water may accumulate and damage the bearing. The use of plain bearings further advantageously eliminates the need to use metallic parts in the bearings, which may rust, oxidize or otherwise be damaged by natural elements such as air and rain.

It will be appreciated that this exercise machine is particularly well adapted to be used in outdoor gyms, which usually includes one or more exercise machines installed in a public area such as a park or a beach. In one example, the exercise machines may be owned by a public operator such as a municipality and be freely accessible to the population, which may advantageously contribute to improving the health and general well-being of the population. In another example, the exercise machines may be operated by an operator such as a municipality or a privately-owned company and be used by users in exchange for a fee. Since plain bearings are more resistant than other types of bearings to natural elements such as air and rain, this will advantageously reduce the costs associated with repairs or replacements of a damaged exercise machine.

Although the exercise machine 100 illustrated in FIGS. 1 to 12 is configured as an elliptical trainer, it will be appreciated that the exercise machine 100 may instead be configured as a stationary bicycle or any other exercise machine which uses pivot movement to enable a user to exercise.

Although the above description relates to a specific preferred embodiment as presently contemplated by the inventor, it will be understood that the invention in its broad aspect includes mechanical and functional equivalents of the elements described herein.

The invention claimed is:

1. An exercise machine comprising:
- a frame;
- a wheel assembly rotatably mounted to the frame;
- an actuating assembly operatively connected to the wheel assembly, the actuating assembly being operable by a user to urge rotation of the wheel assembly;
  - wherein the frame comprises a wheel mounting member for mounting the wheel assembly to the frame, the wheel mounting member being generally flat and having a central opening defined therein, the wheel assembly comprising
    - a first outer wheel portion;
    - a second outer wheel portion extending parallel to the first outer wheel portion and spaced apart therefrom;
    - a wheel axle extending between the first outer wheel portion and the second outer wheel portion;
    - a central mounting plate sized and shaped for engaging the central opening of the wheel mounting member, the central mounting plate being parallel to the wheel mounting member, the central mounting plate having a concave indent defined therein for rotatably receiving the wheel axle; and
  - wherein the actuating assembly comprises
    - an actuating assembly axle;
    - first and second members mounted to the actuating assembly axle, at least one of the first member and the second member being rotatable to enable pivoting of the second member relative to the first member, the first member comprising a first side surface extending perpendicularly to the actuating assembly axle, the second member comprising a second side surface parallel to the first side surface and spaced therefrom; and
    - a first plain bearing element slidably mounted between the first member and the second member to enable frictionless pivoting of the first member relative to the second member, the first plain bearing element contacting the first side surface and the second side surface, the first plain bearing element being slidably movable relative to at least one of the first side surface and the second side surface.

2. The exercise machine as claimed in claim 1, wherein the actuating assembly comprises:
- a lever arm pivotably connected to the frame, the lever arm having a first end defining a handle and a second end; and
- a pedal member having a first end pivotably connected to the second end of the lever arm and a second end pivotably connected to the wheel assembly.

3. The exercise machine as claimed in claim 2, wherein the actuating assembly further comprises a rear pivoting assembly for pivotably connecting the second end of the lever arm to the wheel assembly, the rear pivoting assembly being positioned eccentrically relative to the wheel assembly.

4. The exercise machine as claimed in claim 3, wherein the rear pivoting assembly comprises:

a pivot pin extending away from the wheel assembly;

an annular plain bearing pivotably mounted on the pivot pin; and an annular sleeve connected to the second end of the pedal member, the annular sleeve being slidably engaged over the annular plain bearing, the annular plain bearing enabling frictionless pivoting of the annular sleeve relative to the pivot pin.

5. The exercise machine as claimed in claim 4, wherein the annular plain bearing is manufactured from a material having a low coefficient of friction selected from a group consisting of nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber and fiberglass.

6. The exercise machine as claimed in claim 1, wherein the first member comprises an elongated housing secured to the frame, the housing having a first end portion, a second end portion and a chamber extending between the first end portion and the second end portion for housing the actuating assembly axle.

7. The exercise machine as claimed in claim 6, wherein the first end portion comprises a first exterior planar surface defining the first side surface.

8. The exercise machine as claimed in claim 7, wherein the second end portion comprises a second exterior planar surface defining a third side surface, the exercise machine further comprising:

a holding member secured to the actuating assembly axle, the holding member being adjacent the second end portion of the housing for holding the housing between the holding member and the second member, the holding member having a fourth side surface facing towards the housing; and a second plain bearing element mounted between the holding member and the second end portion, the second plain bearing element contacting the third side surface and the fourth side surface to enable frictionless pivoting of the housing relative to the holding member.

9. The exercise machine as claimed in claim 6, wherein the frame comprises a receiving recess sized and shaped for slidably receiving the housing.

10. The exercise machine as claimed in claim 1, wherein the wheel assembly comprises a first spacer mounted on the wheel axle between the first outer wheel portion and the wheel mounting member for enabling frictionless rotation of the first outer wheel portion relative to the wheel mounting member.

11. The exercise machine as claimed in claim 10, wherein the wheel assembly further comprises a second spacer mounted on the wheel axle between the second outer wheel portion and the wheel mounting member for enabling frictionless rotation of the second outer wheel portion relative to the wheel mounting member.

12. The exercise machine as claimed in claim 1, wherein the first plain bearing element is manufactured from a material having a low coefficient of friction selected from a group consisting of nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber and fiberglass.

13. The exercise machine as claimed in claim 1, wherein the first plain bearing element is disc-shaped.

14. The exercise machine as claimed in claim 1, wherein the central mounting plate is manufactured from a material having a low coefficient of friction selected from a group consisting of nylon, polytetrafluoroethylene (PTFE), polyester resins, polyoxymethylene (POM), polyvinyl chloride (PVC), ultra-high-molecular-weight polyethylene (UHMWPE), polyether ether ketone (PEEK), carbon graphite, wood, ceramic, rubber and fiberglass.

15. The exercise machine as claimed in claim 1, wherein the exercise machine is one of an elliptical machine and a stationary bicycle.

* * * * *